US011814264B1

(12) United States Patent
Rohrer et al.

(10) Patent No.: US 11,814,264 B1
(45) Date of Patent: Nov. 14, 2023

(54) YOKE ASSEMBLY FOR SUSPENDING AN ELEVATOR CAR OR A COUNTERWEIGHT IN A SHAFT OF AN ELEVATOR

(71) Applicant: Inventio AG, Hergiswil (CH)

(72) Inventors: Daniel Rohrer, Sarnen (CH); Richard Hollowell, Avon, CT (US)

(73) Assignee: INVENTIO AG, Hergiswil (CH)

( * ) Notice: Subject to any disclaimer, the term of this patent is extended or adjusted under 35 U.S.C. 154(b) by 0 days.

(21) Appl. No.: 18/057,293

(22) Filed: Nov. 21, 2022

(51) Int. Cl.
*B66B 17/12* (2006.01)
*B66B 11/00* (2006.01)

(52) U.S. Cl.
CPC ..... *B66B 17/12* (2013.01); *B66B 11/008* (2013.01)

(58) Field of Classification Search
CPC ..... B66B 11/008; B66B 7/08; B66B 7/12
See application file for complete search history.

(56) References Cited

U.S. PATENT DOCUMENTS

| | | | | |
|---|---|---|---|---|
| 2017/0283221 | A1 | 10/2017 | St. Pierre et al. | |
| 2019/0233253 | A1* | 8/2019 | St. Pierre | B66B 11/004 |

FOREIGN PATENT DOCUMENTS

| | | | | |
|---|---|---|---|---|
| CN | 108792897 | A * | 11/2018 | B66B 11/043 |
| CN | 114408710 | A * | 4/2022 | |
| EP | 3085656 | A1 | 10/2016 | |
| KR | 101432451 | B1 * | 8/2014 | |
| WO | WO-2008148414 | A1 * | 12/2008 | B66B 11/008 |
| WO | WO-2010086492 | A1 * | 8/2010 | B66B 11/0206 |

* cited by examiner

*Primary Examiner* — Diem M Tran
(74) *Attorney, Agent, or Firm* — William J. Clemens; Shumaker, Loop & Kendrick, LLP

(57) ABSTRACT

A yoke assembly for suspending an elevator car or a counterweight in a shaft of an elevator has a yoke adapted to be mechanically coupled to the elevator car or the counterweight. The yoke has a height with respect to a height axis and a length with respect to a longitudinal axis orthogonal to the height axis; a pulley for suspending the yoke, wherein the pulley has a diameter equal to or less than the height of the yoke and is attached to the yoke so as to be rotatable about an axis of rotation whose position with respect to the height axis is such that the pulley does not protrude beyond the yoke in either direction of the height axis; wherein, when the yoke is suspended in the shaft, the height axis is a vertical axis and the axis of rotation is a horizontal axis.

15 Claims, 4 Drawing Sheets

YOKE ASSEMBLY FOR SUSPENDING AN ELEVATOR CAR OR A COUNTERWEIGHT IN A SHAFT OF AN ELEVATOR

FIELD OF THE INVENTION

The invention relates to a yoke assembly for suspending an elevator car or a counterweight in a shaft of an elevator. The invention further relates to an elevator.

BACKGROUND OF THE INVENTION

An elevator car (or a counterweight) may be suspended in a shaft of an elevator by means of a yoke as an upper part of a frame that carries the elevator car (or the counterweight). The yoke may include one or more pulleys for suspending the yoke by means of one or more tension members, such as a cable or a belt. Usually, the pulleys are placed above the yoke.

EP 3 085 656 A1 describes a yoke as part of a support structure for supporting an elevator car or a counterweight in a shaft of an elevator. The yoke comprises a pulley and two parallel beams separated from each other by a horizontal gap. The pulley is arranged within the gap so that part of it protrudes beyond a lower end of the yoke.

US 2017/0283221 A1 describes a counterweight for an elevator. The counterweight comprises a counterweight frame and a counterweight hitch for suspending the counterweight in a shaft of the elevator by means of a plurality of tension members. The counterweight hitch is attached to the top of the counterweight frame.

SUMMARY OF THE INVENTION

It may be seen as an objective of the invention to provide a yoke assembly with reduced height. This makes it possible to reduce the height of the shaft head accordingly.

Another objective of the invention may be to provide a corresponding elevator.

These objectives may be achieved by the subject matter of the independent claims. Advantageous embodiments are defined in the dependent claims, as well as in the following description and the attached drawings.

A first aspect of the invention relates to a yoke assembly for suspending an elevator car or a counterweight in a shaft of an elevator. The yoke assembly comprises: a yoke adapted to be mechanically coupled to the elevator car or the counterweight, wherein the yoke has a certain height with respect to a height axis and a certain length with respect to a longitudinal axis orthogonal to the height axis; a pulley for suspending the yoke in the elevator shaft by means of a tension member, wherein the pulley has a diameter equal to or less than the height of the yoke and is attached to the yoke so as to be rotatable about an axis of rotation whose position with respect to the height axis is such that the pulley does not protrude beyond the yoke in either direction of the height axis; wherein, when the yoke is suspended in the shaft, the height axis is a vertical axis and the axis of rotation is a horizontal axis.

The yoke assembly makes it possible to reduce the height of the shaft head (also referred to as overhead), as there is no additional structure above or below the yoke. Thus, the shaft length can be significantly reduced, which may reduce the costs for the building in which the elevator is to be installed.

It is understood that the length of the yoke is significantly greater than its height. For example, the length may be at least twice, at least four times, or at least ten times the height.

For example, the (outer) diameter of the pulley may be equal to or less than 90% of the height of the yoke. In some cases, the diameter may be equal to or less than 75% of the height of the yoke.

A "pulley" as described above and below may be a single pulley or a combination of at least two single pulleys having the same axis of rotation. The single pulleys may have identical properties, e.g., have the same dimensions. However, they may also differ from each other, e.g., in their dimensions.

The yoke assembly may also comprise more than one pulley, e.g., two, three, four, or more than four pulleys having identical or different (e.g., parallel) axes of rotation.

In a preferred embodiment, the vertical position of the axis of rotation (i.e., its position with respect to the height axis) may be equal or close to the vertical position of a centerline of the yoke. The term "close" may mean, for example, a deviation of 30 cm or less, preferably 10 cm or less, more preferably 1 cm or less, between the two vertical positions.

A second aspect of the invention relates to an elevator. The elevator comprises: an elevator car and a yoke assembly as described above and below, wherein the yoke is mechanically coupled to the elevator car and suspended in a shaft of the elevator by means of a tension member that at least partially surrounds the pulley; and/or a counterweight and a yoke assembly as described above and below, wherein the yoke is mechanically coupled to the counterweight and suspended in the shaft by means of a tension member that at least partially surrounds the pulley.

A tension member may be, for example, a cable, a belt, or a combination of at least two of these examples.

As mentioned above, such an elevator may have a significantly reduced shaft head height as compared to conventional elevators where the pulley protrudes, or the pulleys protrude, beyond the yoke in one or both directions of the (vertical) height axis.

When the tension member is a belt, the pulley may have a diameter of less than 130 mm and preferably less than 100 mm. This further helps to optimize the use of space.

Embodiments of the invention may be regarded as based on the ideas and findings described below without limiting the scope of the invention.

According to an embodiment, the axis of rotation may be orthogonal or parallel to the longitudinal axis.

According to an embodiment, the pulley may be arranged next to the yoke so as to face a longitudinal side of the yoke. In other words, the pulley may be located completely outside the yoke while facing an outer side of a yoke part, such as a beam or a side wall, whose longitudinal axis is parallel to the longitudinal axis of the yoke. In this case, the axis of rotation of the pulley may be orthogonal to the longitudinal axis of the yoke (part). However, the axis of rotation may also be parallel to it.

According to an embodiment, the yoke may comprise two yoke parts having longitudinal axes parallel to the longitudinal axis of the yoke. In this case, the pulley may be arranged within a (horizontal) gap between the two yoke parts. In other words, the pulley may be located completely inside the yoke. This may reduce the width of the yoke (with respect to a transverse axis orthogonal to both the height axis and the longitudinal axis of the yoke) as compared to embodiments where the pulley is arranged next to the yoke.

In particular, the position of the axis of rotation of the pulley with respect to the height axis may be such that the pulley does not protrude beyond one or both of the yoke parts in either direction of the height axis. A "yoke part" may be, for example, a beam or a side wall of the yoke. The two yoke parts may be parallel to each other. In other words, they may have substantially the same position with respect to the height axis, but different positions with respect to the transverse axis.

According to an embodiment, the yoke assembly may further comprise a further pulley for suspending the yoke in the shaft by means of a tension member, wherein the further pulley has a diameter equal to or less than the height of the yoke and is attached to the yoke so as to be rotatable about a further axis of rotation whose position with respect to the height axis is such that the further pulley does not protrude beyond the yoke in either direction of the height axis.

The pulley and the further pulley may have identical properties, e.g., have the same dimensions and/or the same axis of rotation. However, they may also differ from each other, e.g., in their dimensions and/or axis of rotation.

The pulley and the further pulley may have the same position or different positions with respect to the height axis (as long as none of them protrudes beyond the yoke in either direction of the height axis). In some embodiments, both pulleys may have the same position with respect to the longitudinal axis and different positions with respect to a transverse axis orthogonal to both the longitudinal axis and the height axis. In some other embodiments, the pulleys may have different positions with respect to the longitudinal axis and the same position with respect to the transverse axis.

The yoke assembly may also comprise more than one further pulley, e.g., two, three, four, or more than four further pulleys.

According to an embodiment, the further pulley may be arranged next to the yoke so as to face a longitudinal side of the yoke. In this case, the pulley and the further pulley may face different longitudinal sides of the yoke. In other words, the further pulley, as well as the pulley, may be located completely outside the yoke, wherein the yoke, in its longitudinal direction, may run through a (horizontal) gap between the two pulleys. Additionally, the axis of rotation of each pulley may be orthogonal to the longitudinal axis of the yoke. Furthermore, both pulleys may have the same axis of rotation.

According to an embodiment, the further pulley may be arranged within the (horizontal) gap between the two yoke parts. In other words, the further pulley, as well as the pulley, may be located completely inside the yoke. This may reduce the width of the yoke (with respect to the transverse axis) as compared to embodiments where the pulleys are arranged next to the yoke.

According to an embodiment, the axis of rotation may be parallel to or collinear (i.e., identical) with the further axis of rotation.

According to an embodiment, the yoke assembly may further comprise a support structure for attaching the pulley and the further pulley to the yoke. The support structure may comprise: a base plate having a first attachment portion and a second attachment portion; a connecting plate having a first opening and a second opening and being attached to both the yoke and the base plate so that the first opening faces the first attachment portion and the second opening faces the second attachment portion; a first bracket attached at one end to the first attachment portion and extending from the first attachment portion through the first opening so that another end of the first bracket protrudes from the first opening, wherein the pulley is rotatably attached to the protruding end of the first bracket; a second bracket attached at one end to the second attachment portion and extending from the second attachment portion through the second opening so that another end of the second bracket protrudes from the second opening, wherein the further pulley is rotatably attached to the protruding end of the second bracket.

Such a support structure is stiff enough to ensure that the axes of rotation of the pulleys remain correctly aligned during operation of the elevator. Using plates to build the support structure may also reduce the manufacturing costs as compared to using more complex parts, such as milled or cast parts.

A "plate" as described above and below may be a metal plate. However, other plate materials may also be used.

The base plate and the connecting plate may be parallel to each other.

In some embodiments, the yoke, preferably with its bottom end, may touch the connecting plate in an area between the first bracket and the second bracket.

In some other embodiments, the yoke, preferably with its bottom end, may touch the connecting plate in one or more areas extending along its entire length or width. Such an area may be, for example, adjacent to one of the longitudinal edges of the connecting plate.

According to an embodiment, a (vertical) gap between the base plate and the connecting plate may be at least partially filled with a rubber material that mechanically couples the base plate to the connecting plate. This may significantly reduce unwanted vibrations and/or noise during operation of the elevator.

According to an embodiment, the support structure may further comprise a u-shaped profile. In this case, the base plate may be combined with the u-shaped profile to form a hollow, preferably rectangular, profile, e.g., by bolting and/or bonding (preferably welding) the parts together. This may significantly increase the stability and/or stiffness of the support structure (as compared, for example, to an embodiment where the base plate is a single plate) without excessively increasing the weight and/or the manufacturing costs of the support structure.

According to an embodiment, the first bracket may comprise a first plate and a second plate parallel to the first plate. In this case, the pulley may have an axle attached at its first end to the first plate and at its second end to the second plate.

According to an embodiment, the second bracket may comprise a first plate and a second plate parallel to the first plate. In this case, the further pulley may have an axle attached at its first end to the first plate and at its second end to the second plate.

Such a bracket can be made very easily.

According to an embodiment, the first bracket may further comprise a third plate and a fourth plate parallel to the third plate. In this case, the first plate and the second plate of the first bracket may be interconnected on a first side by the third plate and on a second side opposite the first side by the fourth plate.

According to an embodiment, the second bracket may further comprise a third plate and a fourth plate parallel to the third plate. In this case, the first plate and the second plate of the second bracket may be interconnected on a first side by the third plate and on a second side opposite the first side by the fourth plate.

This may significantly increase the stability and/or stiffness of the respective bracket without excessively increasing the weight and/or the manufacturing costs of the support structure.

For example, the four plates of the respective bracket may be bolted and/or bonded (preferably welded) together.

According to an embodiment, the yoke assembly may further comprise a frame for carrying the elevator car or the counterweight. In this case, the yoke may be a part of the frame. The yoke may be located above the elevator car when suspended in the shaft as part of the frame carrying the elevator car or above the counterweight when suspended in the shaft as part of the frame carrying the counterweight. In other words, the yoke may be an upper part of the frame when the frame is arranged in the shaft so as to be movable in a vertical direction.

BRIEF DESCRIPTION OF THE DRAWINGS

Advantageous embodiments of the invention are described in more detail below with reference to the attached drawings. Neither the description nor the drawings are to be construed as limiting the scope of the invention.

DETAILED DESCRIPTION OF THE INVENTION

Figure 1:
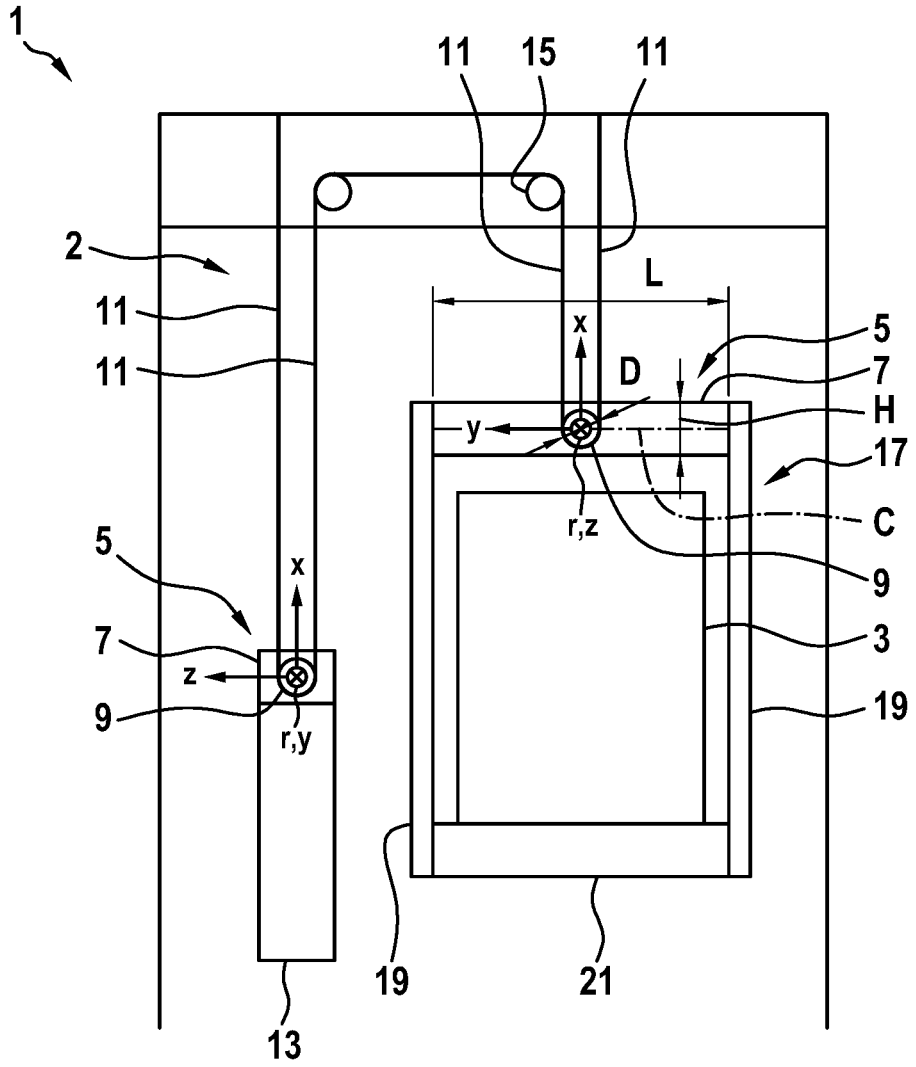
FIG. 1 shows an elevator comprising a yoke assembly.

The figures are merely schematic and not to scale. Identical reference signs in the drawings denote identical features or features having the same effect.

FIG. 1 shows an elevator 1 having a shaft 2 in which an elevator car 3 is suspended by means of a yoke assembly 5. The yoke assembly 5 comprises a yoke 7 mechanically coupled to the elevator car 3. The yoke 7 has a height H with respect to a vertical height axis x and a length L with respect to a horizontal longitudinal axis y. Attached to the yoke 7 is a pulley 9 having a diameter D equal to or less than the height H. Preferably, the diameter D is 90% or less (or even 75% or less) of the height H. The pulley 9 is rotatable about a horizontal axis of rotation r whose x-position is such that the pulley 9 does not protrude beyond the yoke 7 in either direction of x. In particular, the x-position of r may be equal or close to the x-position of a centerline c of the yoke 7, as shown here. For example, the deviation between the two x-positions may be less than 30 cm, less than 10 cm, or even less than 1 cm. In addition, r is orthogonal to y.

The yoke 7 is suspended in the shaft 2 by means of a tension member 11 (e.g., a cable, a belt, or a combination of at least two of these examples), which surrounds a part of a circumferential surface of the pulley 9.

The tension member 11 couples the elevator car 3 to a counterweight 13 and is driven by a traction pulley 15 coupled to a motor. Thus, moving the traction pulley 15 in one direction causes the elevator car 3 and the counterweight 13 to move vertically in opposite directions.

In this example, the yoke assembly 5 further comprises a frame 17 that carries the elevator car 3. The yoke 7, as an upper part of the frame 17, is located above the elevator car 3. The yoke 7 is coupled at each of its ends by an upright 19 to a bottom 21 that carries the elevator car 3.

Like the elevator car 3, the counterweight 13 may be suspended in the shaft 2 by means of a yoke assembly 5. In this example, the axis of rotation r of the pulley 9 is parallel to y, i.e., orthogonal to a transverse axis z corresponding to a width direction of the yoke 7. However, r may also be orthogonal to y. The yoke 7 is located above the counterweight 13.

Although not shown in FIG. 1, a frame 17 may be part of the yoke assembly 5 of the counterweight 13 and carry the counterweight 13 in the same or a similar way as it carries the elevator car 3.

With respect to the longitudinal axis y, the axis of rotation r may be positioned above the center of gravity of the elevator car 3 (more precisely of a combination of the elevator car 3 and the yoke assembly 5) or above the center of gravity of the counterweight 13 (more precisely of a combination of the counterweight 13 and the yoke assembly 5). This ensures that the suspended elevator car 3, or the suspended counterweight 13, is well balanced. However, in some cases, the axis of rotation r may also be horizontally offset to the respective center of gravity.

Such an elevator may have a significantly reduced shaft head height as compared to conventional elevators where the pulley usually protrudes beyond the yoke in one or both directions of the height axis x.

Figure 2:
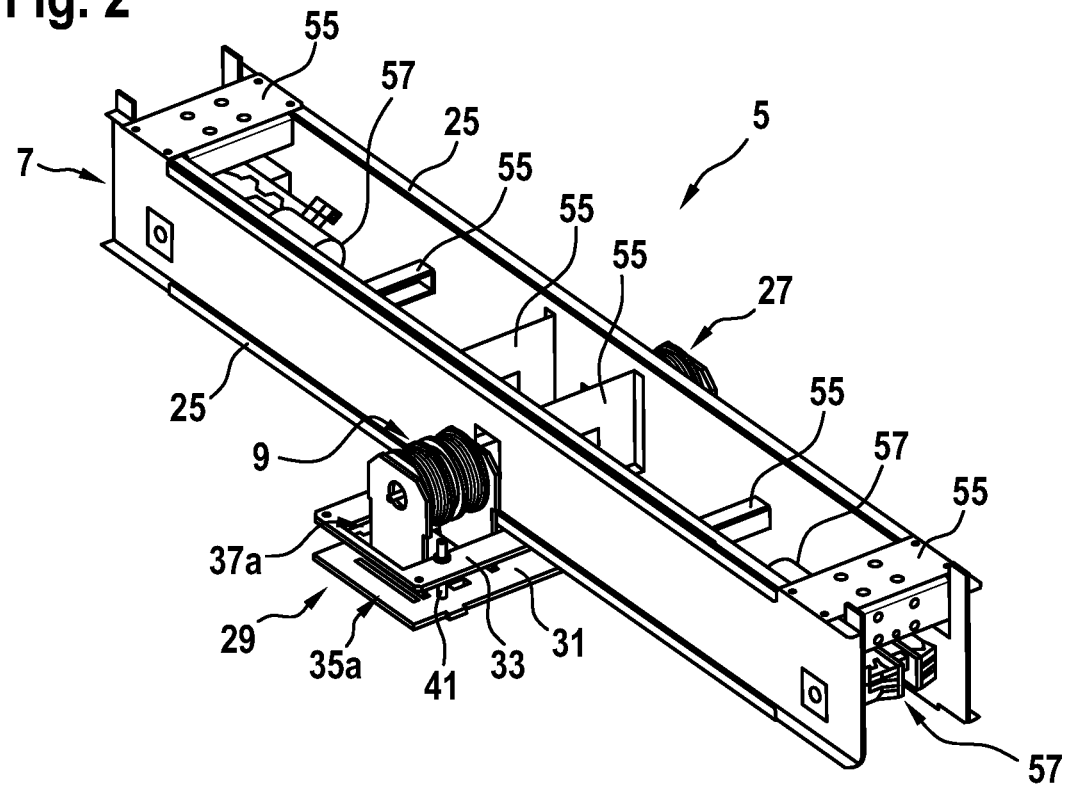
FIG. 2 shows a perspective view of a first embodiment of the yoke assembly.
Figure 3:
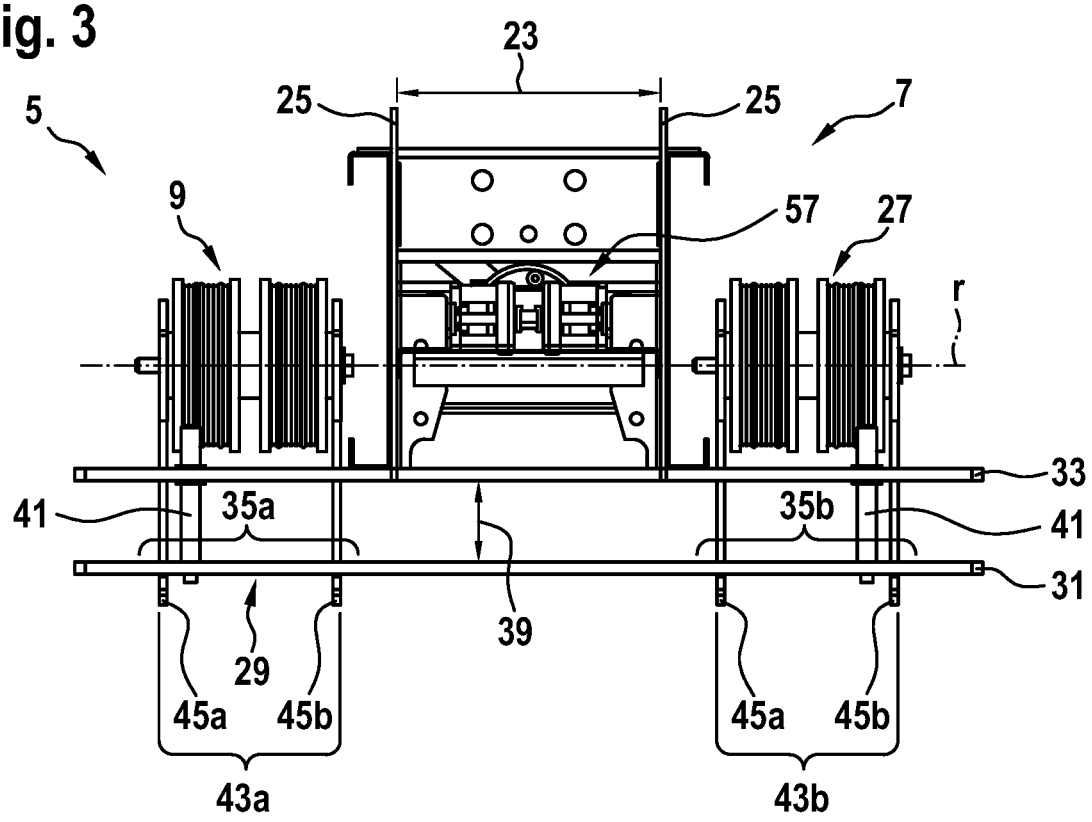
FIG. 3 shows the yoke assembly of FIG. 2 viewed from the side.
Figure 4:
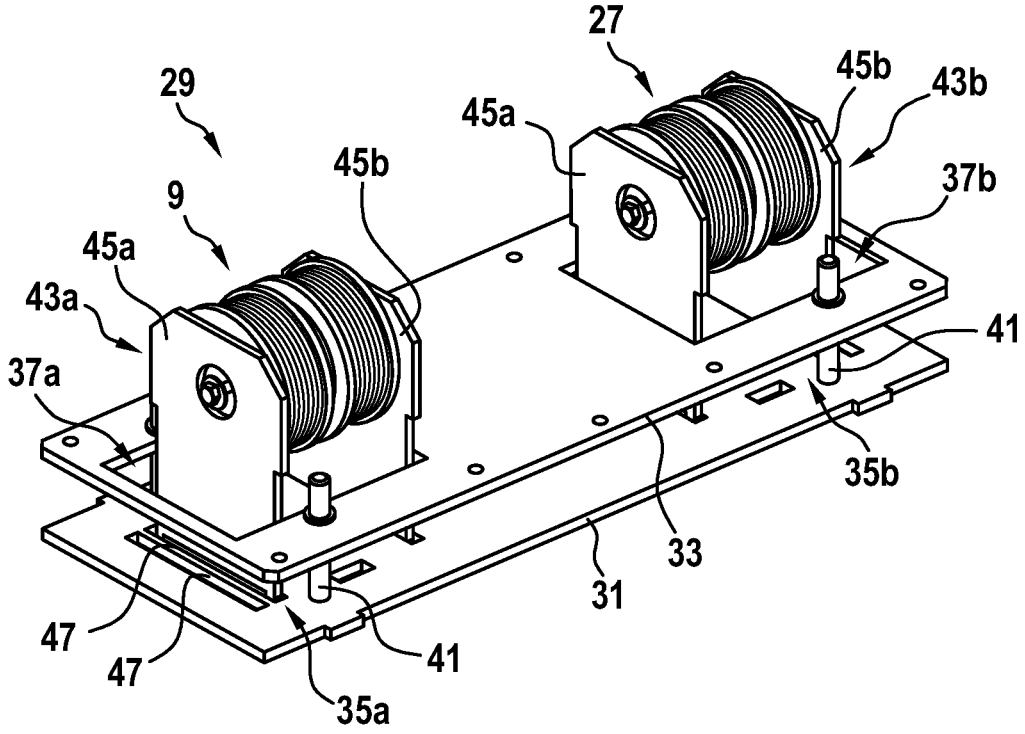
FIG. 4 shows a perspective view of a support structure used in the yoke assembly of FIG. 2.
Figure 5:
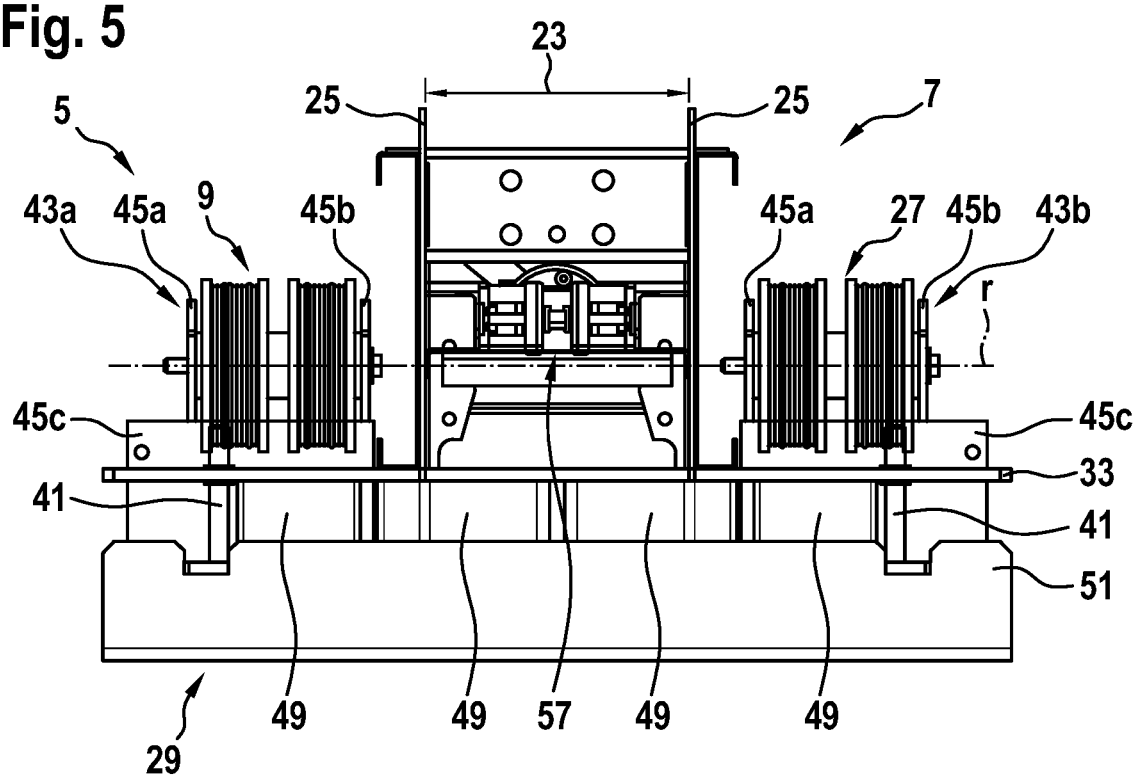
FIG. 5 shows a second embodiment of the yoke assembly viewed from the side.
Figure 6:
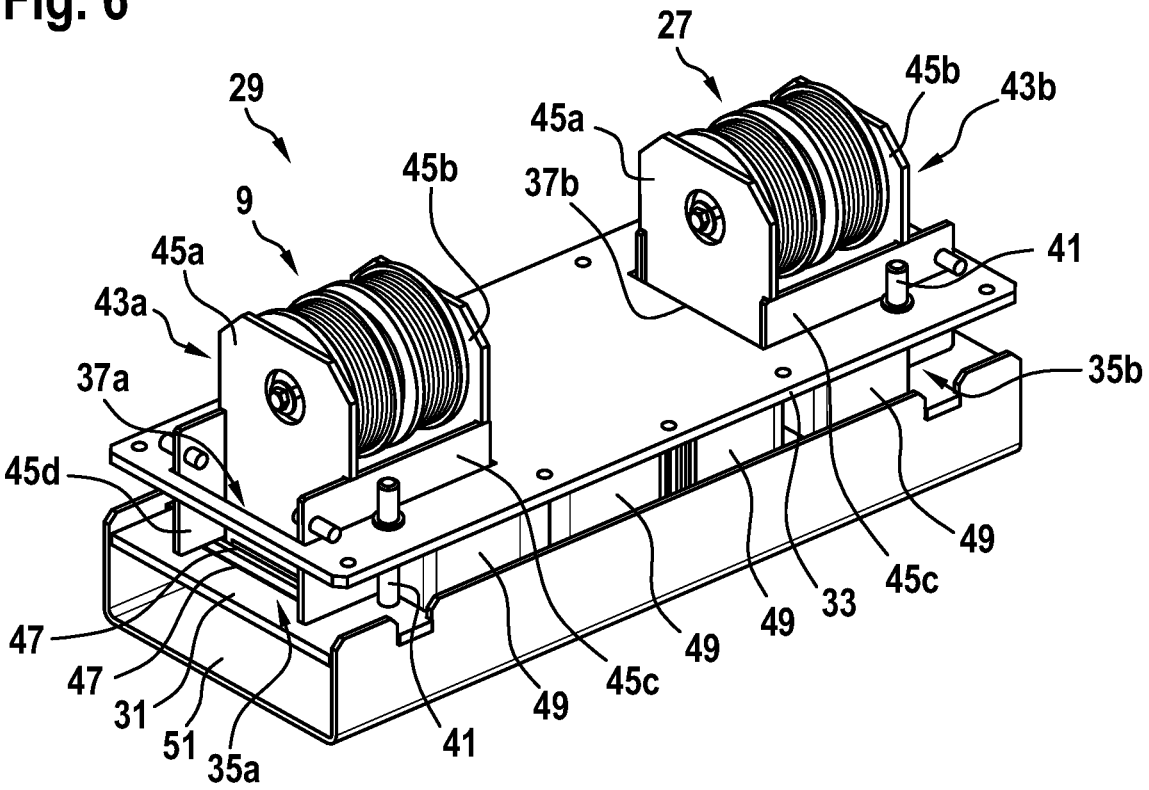
FIG. 6 shows a perspective view of a support structure used in the yoke assembly of FIG. 5.

As shown in FIG. 2, FIG. 3, and FIG. 5, the pulley 9 may be arranged next to the yoke 7 so as to face one of its longitudinal sides.

Figure 7:
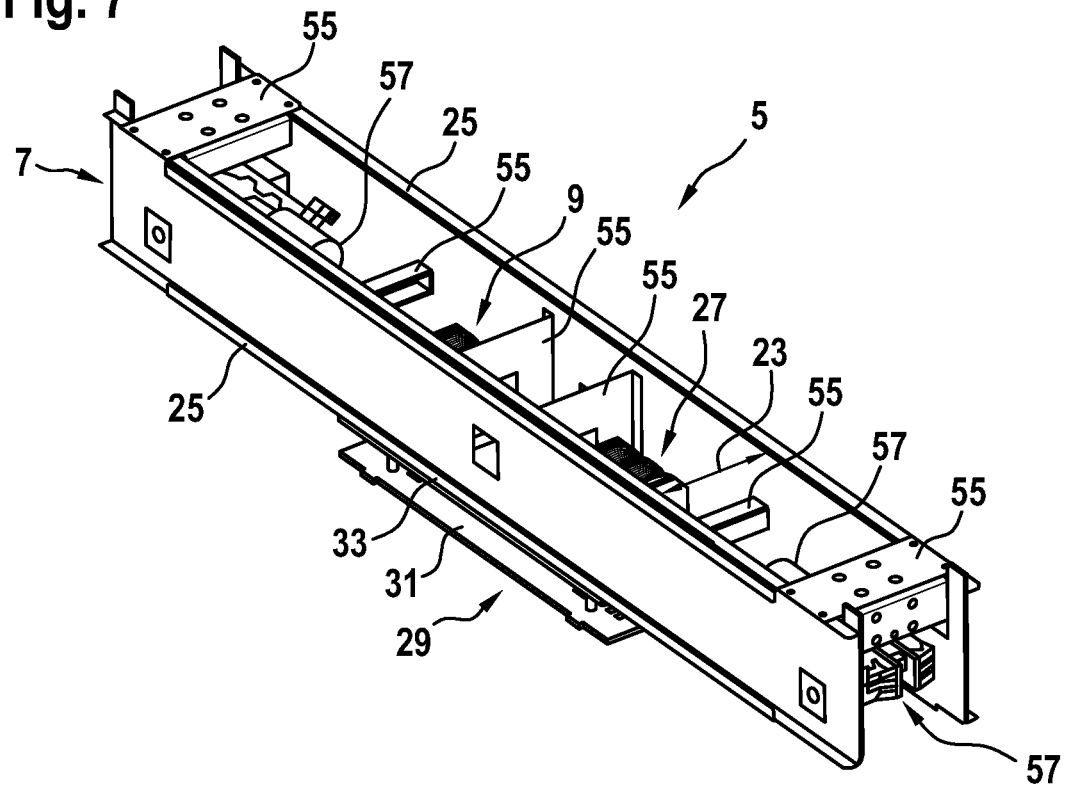
FIG. 7 shows a perspective view of a third embodiment of a yoke assembly.

Alternatively, as shown in FIG. 7, the pulley 9 may be located completely inside the yoke 7, more specifically in a horizontal gap 23 (see also FIG. 3 and FIG. 5) between two parallel yoke parts 25, such as beams or side walls, which may be plate-shaped, for example.

As shown in FIG. 2 to FIG. 7, the yoke assembly 5 may additionally comprise a further pulley 27 for suspending the yoke 7 in the shaft 2 by means of a tension member 11. In this case, the pulleys 9, 27 may each be attached to a support structure 29 in such a way that their respective axes of rotation r are collinear with each other.

However, in some cases, the axes of rotation r may also be parallel to each other.

The support structure 29, in turn, is attached to the yoke 7, here to a bottom end of each of the two yoke parts 25.

As shown in FIG. 2, FIG. 3, and FIG. 5, the pulleys 9, 27 may be coupled by the support structure 29 to the yoke 7 in such a way that they face different longitudinal sides of the yoke 7 and the collinear axes of rotation r are orthogonal to the longitudinal axis y.

As an alternative (see FIG. 7), the pulleys 9, 27 may be coupled by the support structure 29 to the yoke 7 in such a way that they are located completely inside the yoke 7, i.e., in the horizontal gap 23, and the collinear axes of rotation r are parallel to the longitudinal axis y.

In both cases, the pulleys 9, 27 should be arranged symmetrically to the respective center of gravity (see also above).

Each of the pulleys 9, 27 may be a single pulley or a combination, e.g., a stack, of two (as shown here) or even more than two single pulleys rotatable about the same axis of rotation r. In this example, the single pulleys of each pulley 9, 27 have the same diameter D and the same width. However, they may also differ from each other to some extent in some cases.

In this example, the support structure 29 is a combination of a plurality of plates, namely a base plate 31 and a connecting plate 33, which are preferably metal plates.

The base plate 31 has a first attachment portion 35*a* and a second attachment portion 35*b*. The connecting plate 33 has a first opening 37*a* and a second opening 37*b*. Each of the openings 37*a*, 37*b* connects a bottom side with a top side of the connecting plate 33. The plates 31, 33 are arranged in such a way that the first opening 37*a* faces the first attachment portion 35*a* and the second opening 37*b* faces the second attachment portion 35*b*.

The plates 31, 33 may be parallel to each other. Furthermore, they may be separated from each other by a vertical gap 39 (see FIG. 3) of a defined height with respect to the height axis x. For example, the plates 31, 33 may be aligned with each other by means of a plurality of bolts 41 (here four bolts) connected at each of their ends to one of the plates 31, 33.

The support structure 29 is connected, e.g., bolted and/or bonded (especially welded), to the yoke 7 via the connecting plate 33. In this example, the connecting plate 33 is connected to the yoke 7 so that the top side of the connecting plate 33 touches a bottom side of each yoke part 25. This means that the connecting plate 33, with respect to the height axis x, is located below the yoke 7 and between the base plate 31 and the yoke 7.

The support structure 29 further comprises a first bracket 43*a* for holding the pulley 9 and a second bracket 43*b* for holding the further pulley 27.

The first bracket 43*a* is attached at one end to the first attachment portion 35*a* and extends from the first attachment portion 35*a* through the first opening 37*a* so that its other end protrudes from the first opening 37*a*. The pulley 9 is rotatably attached to the protruding end of the first bracket 43*a*.

The second bracket 43*b* is attached at one end to the second attachment portion 35*b* and extends from the second attachment portion 35*b* through the second opening 37*b* so that its other end protrudes from the second opening 37*b*. The further pulley 27 is rotatably attached to the protruding end of the second bracket 43*b*.

Preferably, each pulley 9, 27 is attached to its respective bracket so as not to protrude into the vertical gap 39.

In this example (see FIG. 5 and FIG. 6), each bracket 43*a*, 43*b* is composed of a first plate 45*a*, a second plate 45*b*, a third plate 45*c*, and a fourth plate 45*d*. The first plate 45*a* and the second plate 45*b* of each bracket 43*a*, 43*b* are parallel to each other. The respective pulley 9, 27 is arranged within a horizontal gap between the two plates 45*a*, 45*b* and has its axle attached at one end to the first plate 45*a* and at the other end to the second plate 45*b*.

Each plate 45*a*, 45*b* may be inserted, e.g., pressed, with one of its ends in one of a plurality of recesses 47 in the base plate 31 within one of the attachment portions 35*a*, 35*b*. In addition, the plates 45*a*, 45*b* are bonded, preferably welded, to the base plate 31.

Furthermore, the first plate 45*a* and the second plate 45*b* of each bracket 43*a*, 43*b* are interconnected on a first side by the respective third plate 45*c* and on a second side opposite the first side by the respective fourth plate 45*d*. The plates 45*c*, 45*d* of each bracket 43*a*, 43*b* are parallel to each other. This increases the stability and/or stiffness of the respective bracket, which improves the accuracy with which the axes of rotation r can be aligned with each other.

As shown in FIG. 2, FIG. 3, and FIG. 5, the yoke parts 25 may touch the connecting plate 33 in an area between the first bracket 43*a* and the second bracket 43*b* while running, in their longitudinal direction, through a gap between the two brackets 43*a*, 43*b* (and thus between the two pulleys 9, 27).

Alternatively, as shown in FIG. 7, the yoke parts 25 may touch the connecting plate 33 over its entire length (or width), preferably in areas adjacent to the longitudinal (or transverse) edges of the connecting plate 33.

To reduce unwanted vibrations and/or noise during operation of the elevator 1, i.e., when the elevator car 3 and the counterweight 13 are moved vertically by moving the tension member(s) 11, the vertical gap 39 may be at least partially filled with a rubber material 49 (see FIG. 5 and FIG. 6) that mechanically couples the base plate 31 to the connecting plate 33 by touching both the bottom side of the connecting plate 33 and a top side of the base plate 31.

To further increase the overall stability and/or stiffness of the support structure 29, the base plate 31 may be combined with a u-shaped profile 51 (see FIG. 5 and FIG. 6) to form a hollow profile, which may have a rectangular or square cross section, for example. Preferably, the base plate 31 and the u-shaped profile 51 are bonded, e.g., welded, together. Alternatively, the hollow profile is made as a single part. In this case, the base plate 31 forms a flat upper part of the hollow profile.

The yoke parts 25 may be interconnected by a plurality of links 55, such as plates or rods, to form a stable frame, as shown in FIG. 2 and FIG. 7.

Further (active) components of the elevator 1, such as brake components 57 for stopping the elevator car 3 or the counterweight 13, may be attached to the yoke 7 (see FIG. 2, FIG. 3, FIG. 5, and FIG. 7). Such components are preferably arranged at least partially in the horizontal gap 23 to save space.

Generally, the position of the axes of rotation r should be as close as possible to the centerline c of the yoke 7. To achieve this, a bearing block that supports two pulleys 9, 27 may be split in the center to leave some space for the yoke 7, resulting in two bearing blocks, one for each pulley, on each side. The bearing blocks may be interconnected by a plate or a combination of two or more plates, which ensures correct alignment of the axes of rotation r. The plate (or one of the combined plates) may be connected to the bottom of the yoke 7. This also allows easy integration of a vibration damping device, such as the rubber material 49, coupled to both pulleys.

Finally, it is noted that terms such as "comprising", "including", "having", or "with" do not exclude other elements or steps and that the indefinite article "a" or "an" does not exclude a plurality. It is further noted that features or steps described with reference to one of the above embodiments may also be used in combination with features or steps described with reference to any other of the above embodiments. Reference signs in the claims are not to be construed as limiting the scope of the claims.

The invention claimed is:

1. A yoke assembly for suspending an elevator car or a counterweight in a shaft of an elevator, wherein the yoke assembly comprises:

a yoke adapted to be mechanically coupled to the elevator car or the counterweight, wherein the yoke has a height with respect to a height axis and a length with respect to a longitudinal axis orthogonal to the height axis;

a pulley for suspending the yoke in the shaft by means of a tension member, wherein the pulley has a diameter equal to or less than the height of the yoke and is attached to the yoke so as to be rotatable about an axis of rotation whose position with respect to the height axis is such that the pulley does not protrude beyond the yoke in either direction of the height axis;

wherein, when the yoke is suspended in the shaft, the height axis is a vertical axis and the axis of rotation is a horizontal axis;

a further pulley for suspending the yoke in the shaft by means of a tension member, wherein the further pulley has a diameter equal to or less than the height of the yoke and is attached to the yoke so as to be rotatable about a further axis of rotation whose position with respect to the height axis is such that the further pulley does not protrude beyond the yoke in either direction of the height axis;

a support structure for attaching the pulley and the further pulley to the yoke, wherein the support structure comprises:

a base plate having a first attachment portion and a second attachment portion;

a connecting plate having a first opening and a second opening and being attached to both the yoke and the base plate so that the first opening faces the first attachment portion and the second opening faces the second attachment portion;

a first bracket attached at one end to the first attachment portion and extending from the first attachment portion through the first opening so that another end of the first bracket protrudes from the first opening, wherein the pulley is rotatably attached to the protruding end of the first bracket;

a second bracket attached at one end to the second attachment portion and extending from the second attachment portion through the second opening so that another end of the second bracket protrudes from the second opening, wherein the further pulley is rotatably attached to the protruding end of the second bracket; and wherein a gap between the base plate and the connecting plate is at least partially filled with a rubber material that mechanically couples the base plate to the connecting plate.

2. The yoke assembly of claim 1, wherein the axis of rotation is orthogonal or parallel to the longitudinal axis.

3. The yoke assembly of claim 1, wherein the pulley is arranged next to the yoke so as to face a longitudinal side of the yoke.

4. The yoke assembly of claim 1, wherein the yoke comprises two yoke parts having longitudinal axes parallel to the longitudinal axis of the yoke, wherein the pulley is arranged within a gap between the two yoke parts.

5. The yoke assembly of claim 1, wherein the pulley is arranged next to the yoke so as to face a longitudinal side of the yoke; wherein the further pulley is arranged next to the yoke so as to face a longitudinal side of the yoke; wherein the pulley and the further pulley face different longitudinal sides of the yoke.

6. The yoke assembly of claim 1, wherein the yoke comprises two yoke parts having longitudinal axes parallel to the longitudinal axis of the yoke; wherein the pulley is arranged within a gap between the two yoke parts; wherein the further pulley is arranged within the gap between the two yoke parts.

7. The yoke assembly of claim 1, wherein the axis of rotation is parallel to or collinear with the further axis of rotation.

8. The yoke assembly of claim 1, wherein the support structure further comprises a u shaped profile; wherein the base plate is combined with the u shaped profile to form a hollow profile.

9. The yoke assembly of claim 1, wherein the first bracket comprises a first plate and a second plate parallel to the first plate, wherein the pulley has an axle attached at its first end to the first plate and at its second end to the second plate; and/or wherein the second bracket comprises a first plate and a second plate parallel to the first plate, wherein the further pulley has an axle attached at its first end to the first plate and at its second end to the second plate.

10. The yoke assembly of claim 9, wherein the first bracket further comprises a third plate and a fourth plate parallel to the third plate, wherein the first plate and the second plate of the first bracket are interconnected on a first side by the third plate and on a second side opposite the first side by the fourth plate; and/or wherein the second bracket further comprises a third plate and a fourth plate parallel to the third plate, wherein the first plate and the second plate of the second bracket are interconnected on a first side by the third plate and on a second side opposite the first side by the fourth plate.

11. The yoke assembly of claim 1, further comprising: a frame for carrying the elevator car or the counterweight, wherein the yoke is a part of the frame; wherein the yoke is located above the elevator car when suspended in an elevator shaft as part of the frame carrying the elevator car or above the counterweight when suspended in the shaft as part of the frame carrying the counterweight.

12. An elevator comprising:

an elevator car; and the yoke assembly of claim 1, wherein the yoke of the yoke assembly is mechanically coupled to the elevator car and suspended in a shaft by means of a tension member that at least partially surrounds the pulleys.

13. An elevator comprising:

a counterweight; and the yoke assembly of claim 1, wherein the yoke of the yoke assembly is mechanically coupled to the counterweight and suspended in a shaft by means of a tension member that at least partially surrounds the pulleys.

14. A yoke assembly for suspending an elevator car or a counterweight in a shaft of an elevator, wherein the yoke assembly comprises:

a yoke adapted to be mechanically coupled to the elevator car or the counterweight, wherein the yoke has a height with respect to a height axis and a length with respect to a longitudinal axis orthogonal to the height axis;

a first pulley and a second pulley for suspending the yoke in the shaft by means of a tension member, wherein each of said pulleys is attached to the yoke so as to be rotatable about an axis of rotation;

wherein, when the yoke is suspended in the shaft, the height axis is a vertical axis and the axis of rotation of each pulley is a horizontal axis;

wherein each of said pulleys have a diameter of less than 130 mm;

wherein each axis of rotation is parallel to the longitudinal axis and the axis of rotation of the first pulley and the second pulley are parallel to each other or collinear;

wherein the yoke comprises two yoke parts having longitudinal axes parallel to the longitudinal axis of the yoke;

wherein the first pulley and the second pulley are arranged within a gap between the two yoke parts;

a support structure for attaching the first pulley and the second pulley to the yoke, wherein the support structure comprises:

a base plate having a first attachment portion and a second attachment portion;

a connecting plate having a first opening and a second opening and being attached to both the yoke and the base plate so that the first opening faces the first attachment portion and the second opening faces the second attachment portion;

a first bracket attached at one end to the first attachment portion and extending from the first attachment portion through the first opening so that another end of the first bracket protrudes from the first opening, wherein the first pulley is rotatably attached to the protruding end of the first bracket;

a second bracket attached at one end to the second attachment portion and extending from the second attachment portion through the second opening so that another end of the second bracket protrudes from the second opening, wherein the second pulley is rotatably attached to the protruding end of the second bracket.

15. A yoke assembly for suspending an elevator car or a counterweight in a shaft of an elevator, wherein the yoke assembly comprises:

a yoke adapted to be mechanically coupled to the elevator car or the counterweight, wherein the yoke has a height with respect to a height axis and a length with respect to a longitudinal axis orthogonal to the height axis;

a pulley for suspending the yoke in the shaft by means of a tension member, wherein the pulley has a diameter equal to or less than the height of the yoke and is attached to the yoke so as to be rotatable about an axis of rotation whose position with respect to the height axis is such that the pulley does not protrude beyond the yoke in either direction of the height axis;

wherein, when the yoke is suspended in the shaft, the height axis is a vertical axis and the axis of rotation is a horizontal axis;

a further pulley for suspending the yoke in the shaft by means of a tension member, wherein the further pulley has a diameter equal to or less than the height of the yoke and is attached to the yoke so as to be rotatable about a further axis of rotation whose position with respect to the height axis is such that the further pulley does not protrude beyond the yoke in either direction of the height axis;

a support structure for attaching the pulley and the further pulley to the yoke, wherein the support structure comprises:

a base plate having a first attachment portion and a second attachment portion;

a connecting plate having a first opening and a second opening and being attached to both the yoke and the base plate so that the first opening faces the first attachment portion and the second opening faces the second attachment portion;

a first bracket attached at one end to the first attachment portion and extending from the first attachment portion through the first opening so that another end of the first bracket protrudes from the first opening, wherein the pulley is rotatably attached to the protruding end of the first bracket;

a second bracket attached at one end to the second attachment portion and extending from the second attachment portion through the second opening so that another end of the second bracket protrudes from the second opening, wherein the further pulley is rotatably attached to the protruding end of the second bracket;

wherein the first bracket comprises a first plate and a second plate parallel to the first plate, wherein the pulley has an axle attached at its first end to the first plate and at its second end to the second plate, and/or wherein the second bracket comprises a first plate and a second plate parallel to the first plate, wherein the further pulley has an axle attached at its first end to the first plate and at its second end to the second plate; and wherein the first bracket further comprises a third plate and a fourth plate parallel to the third plate, wherein the first plate and the second plate of the first bracket are interconnected on a first side by the third plate and on a second side opposite the first side by the fourth plate, and/or wherein the second bracket further comprises a third plate and a fourth plate parallel to the third plate, wherein the first plate and the second plate of the second bracket are interconnected on a first side by the third plate and on a second side opposite the first side by the fourth plate.

* * * * *